United States Patent [19]

Wlodawer

[11] 4,033,401

[45] July 5, 1977

[54] PRECISION CASTING PROCESS

[75] Inventor: Robert Wlodawer, Winterthur, Switzerland

[73] Assignee: Sulzer Brothers Limited, Winterthur, Switzerland

[22] Filed: May 12, 1975

[21] Appl. No.: 576,877

[30] Foreign Application Priority Data

May 29, 1974 Switzerland ..... 7307/74

[52] U.S. Cl. ..... 164/121; 164/122; 164/127; 164/361; 249/111

[51] Int. Cl.[2] ..... B22D 27/04

[58] Field of Search ..... 164/121, 122, 125, 127, 164/123, 126, 338 R, 338 M, 361; 249/78, 111

[56] References Cited

UNITED STATES PATENTS

| | | | |
|---|---|---|---|
| 2,420,003 | 5/1947 | Miller | 164/127 X |
| 3,200,455 | 8/1965 | Operhall et al. | 164/121 |
| 3,274,652 | 2/1966 | Banks | 164/125 X |
| 3,346,039 | 10/1967 | Lyons | 164/338 M |
| 3,376,915 | 4/1968 | Chandley | 164/125 X |
| 3,414,042 | 12/1968 | Behrens et al. | 164/122 X |
| 3,472,308 | 10/1969 | Louth | 164/125 X |
| 3,552,479 | 1/1971 | Hockin | 164/122 X |
| 3,680,625 | 8/1972 | Hein et al. | 249/111 X |

FOREIGN PATENTS OR APPLICATIONS

| | | | |
|---|---|---|---|
| 22,181 | 11/1896 | United Kingdom | 164/122 |

*Primary Examiner*—Ronald J. Shore
*Attorney, Agent, or Firm*—Kenyon & Kenyon, Reilly, Carr & Chapin

[57] ABSTRACT

The mold is preheated to a temperature above the maximum local casting temperature prior to casting of the melt and is also cooled to obtain a variation of temperatures throughout the mold. The resulting temperature gradient of the mold is intended to maintain the heat content per unit volume in the unsolidified melt portions greater than in the adjacent solidified melt portions to compensate for the latent heat of solidification in the melt and thus avoid shrinkholes and blowholes.

5 Claims, 2 Drawing Figures

PRECISION CASTING PROCESS

Figure 1:
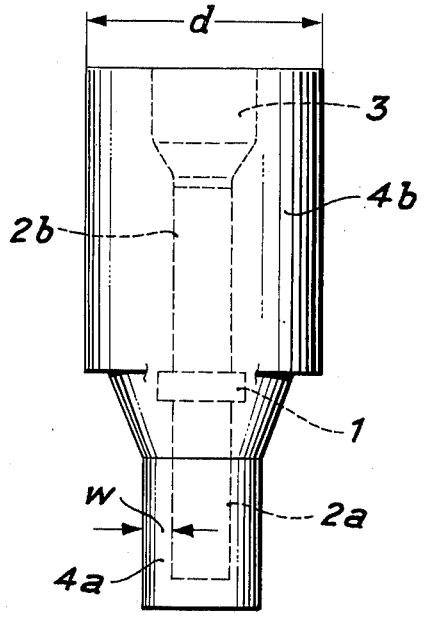

This invention relates to a precision casting process.

As is known, difficulties often arise in the production of precision castings due to the formation of shrinkholes or blowholes. This is generally ascribed to the all-around uniform solidification of the melt in the mold. In order to avoid such shrinkholes it has long been known to control the solidification of the melt in the mold so that solidification does not occur uniformly.

Further, in order to produce a crystal growth in a preferred direction, e.g. for growing large monocrystals which are used, inter alia, for turbine vanes, it has been known to solidify precision castings in a regulated and controlled manner. In such cases, the parts of the mold to be heated are made of ceramic materials while the remaining cold mold parts are made of heat-conductive materials, e.g. graphite or metal, so as to make a complete mold for receiving a molten metal for the casting. In these cases, heating means are used for heating up certain parts of the mold. However, the use of this method is expensive and cumbersome, because the manipulation of hot mold parts is difficult and requires supplementary safety measures. Also, there is a great deal of scrap produced from the different heat-expansion coefficients of the hot and cold parts of the mold. Thus, this process can generally be used only for individual molds, i.e. the process cannot be used to obtain a number of castings connected to a single stem.

It has also been known, e.g. from "Giessereitechnik" 19 of 1973, No. 4, page 136, how to produce a controlled solidification in various regions of a ceramic mold, for the production of thin-walled castings. This is done by the aid of special heating devices to produce different temperatures before the casting operation, thus producing a temperature and heat decrease of desired magnitude and direction in the mold. However, the necessary special heating devices of an electric or thermal nature are likewise expensive and cumbersome, and can generally be used for individual molds.

Accordingly, it is an object of the invention to avoid or diminish shrinkholes in precision castings through a simple and economical controlled solidification process.

It is another object of the invention to provide a precision casting process which allows a simple and economical control of the solidification process.

It is another object of the invention to reduce the amount of scrap produced during a precision casting process.

It is another object of the invention to provide a precision casting process which is able to produce a number of castings connected to a single stem.

It is another object of the invention to use simple relatively inexpensive heating equipment in a controlled precision casting process.

Briefly, the precision casting process of the invention initially provides a preheated casting mold having a mold cavity and a prevailing temperature gradient which decreases from a feed end of the cavity towards an opposite end, for example, from the top of a vertically oriented mold cavity towards the bottom at a rate of at least 10° C per centimeter of distance. Thereafter, a molten metal melt is poured into the feed end of the mold cavity and thereafter the temperature of the melt in the cavity is decreased in the direction of solidification, for example from top to bottom of a vertical cavity at a controlled rate to maintain the heat-content per unit volume in the unsolidified melt portions greater than in the adjacent solidified melt portions. Thus, in accordance with the invention, before the casting operation takes place, the mold is first brought to a temperature above the maximum local casting temperature of the mold and is then cooled for a specified length of time or until a specified temperature is reached at a predetermined location in the mold. Furthermore, the described temperature gradient is obtained by cooling the various locations of the mold at different rates.

The mold may as a whole be heated up in any ordinary furnace to a certain temperature, e.g. at least 300° C and then simply taken out of the furnace and allowed to cool in air for a specified time, e.g. at least 2 minutes, until a specified temperature has been reached at a specified location of the mold. In this way, neither a manipulation of hot mold parts nor special heating devices with limited local action are required.

The differential cooling effect is obtained by a differential rapid cooling down of different locations of the mold. The necessary differential cooling characteristics of the individual locations of the mold can be obtained by a number of means which are of themselves known. For example, the mold may have differing wall-thicknesses made by profiling the external contours. Localized alteration of the density of the mold may also be used, e.g. by inserts of metal or cermet material of a density different from that of the mold material for the purpose of increasing the heat-storage capacity of a location in the mold. Also, part locations of the mold exterior may be insulated from the surroundings by covering them with heated or nonheated insulating hoods after the heating-up and withdrawal of the mold from the furnace. These hoods may, if desired, be removed before the casting operation. Of course, all these means may be combined with one another.

The duration of cooling before the casting operation, and also the shapes and/or dimensions of the aforesaid means may be determined on the basis of known methods of calculation, e.g. by applying the module teaching for solidification within a cast piece, as additionally extended for the controlled cooling of the mold before casting, or on the basis of temperature measuring techniques which are also known.

These and other objects and advantages of the invention will become more apparent from the following detailed description and appended claims taken in conjunction with the accompanying drawing in which:

FIG. 1 schematically illustrates a mold for a camshaft wherein the desired cooling characteristics and, thus, the control of the solidification process are obtained with the aid of a profiled external contour and, thus, locally differing wall-thicknesses of the mold wall.

Figure 2:
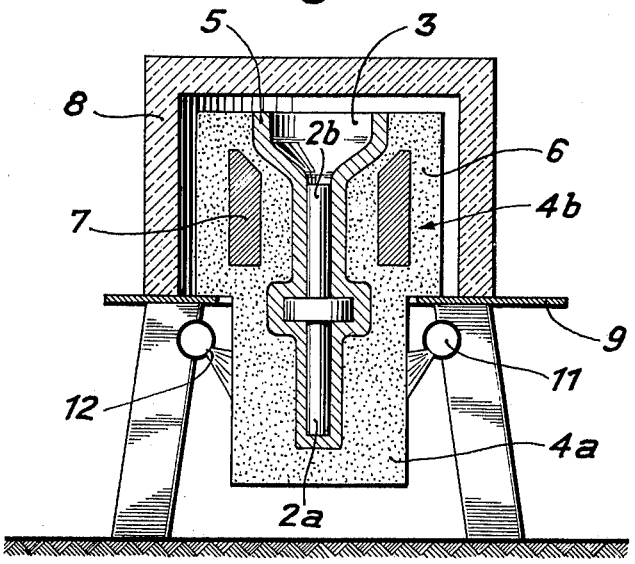

FIG. 2 illustrates a varient of FIG. 1.

For purposes of exemplifying the invention, the following description deals with the casting of a camshaft composed of a heat-treatable alloy steel of the following composition, in percentages by weight: 0.4%C, 1%Cr; 0.2%Mo; 0.6%Si; 0.8%Mn with the remainder iron, and also the inevitable impurities. The casting temperature of the molten metal which may be obtained in the usual way in an induction furnace is 1550° C to 1600° C. The composition of the metal is of itself immaterial for the process of the invention. The process may be applied for any metal used in precision-casting wherein, of course, the desired temperature reductions in the mold walls have a certain relationship to the solidification time of the metal. In the present case, the solidification range Δ T is about 30° and the solidification temperature about 1470° C.

Referring to FIG. 1, in its geometrical form the shaft has two cylindrical portions 2*a*, 2*b* with an intermediate cam 1. As such, the camshaft is in the form of a round rod with a transverse disk. From known considerations, it is evident that without supplementary means, the solidification time in the center of the camshaft (the disk) will take about 25% more time than in the remainder of the camshaft, i.e. in the cylindrical portions 2*a*, 2*b*. It is furthermore evident that the solidification time in the feed end portion 2*b* of the camshaft must be prolonged through supplementary means by about 50% compared with the solidification time in the lower shaft portion 2*a* in order to obtain a controlled solidification which avoids shrinkholes, particularly in the region of the cam 1.

It is also necessary to control the solidification so that solidification progresses continuously from the bottom to the top and so that the liquid metal from the source of supply may flow under air-pressure and gravity into the just solidified and therefore contracted zones. In other words, during the entire solidification time, there must be a specific heat-decrease within the part from the feeder section 3 of the mold downward to the shaft portion 2*a*, so that the heat-content per unit volume in the upper and not yet solidified, or only partly solidified part, is greater than in the lower already completely or almost completely solidified part, in order to compensate for the content of latent or crystallization heat in the non-yet-solidified molten metal.

Such a heat-reduction in the casting is obtained by having different temperatures prevail at different locations of the mold wall just before the casting operation. For example, in the present case the mold inner wall of the shaft portion 2*b* is at 800° C and at the shaft portion 2*a* is at 430° C. Thus, a temperature differential of 370° C exists within the mold. It is noted that the temperatures refer to the center of gravity of the shaft portions 2*b* and 2*a*, respectively. If, for this case, the corresponding temperature gradients Δ T are computed from center of mass to center of mass, then a figure of Δ T = 20 to 22° C per centimeter is obtained inside the hollow space of the mold immediately before the casting operation, in the direction of the required controlled solidification of the casting. Here it should be mentioned that all figures and times relate only to the example selected, so that they have no general validity, and need appropriate modification, through computation or experiment, for other castings. The actual temperature gradient may be computed, or may be determined by determining the temperature pattern by means of a thermo-chain.

During the time the mold stands in the air, as required, the upper portion 4*b* of the mold (giving consideration to the dimensions and cooling characteristics) must cool to such an extent that a temperature of about 800° C prevails after 56 minutes at the mold inner wall for the shaft portion 2*b*. In the same period of time and in the present case, the temperature in the mold portion 4*a* for the camshaft section 2*a*, must have decreased to about 430° C.

From these figures for the temperature distribution chronologically in the mold, the required wall thicknesses may be determined by the aforesaid known methods (if needed, while giving consideration to other operating conditions such as minimum thicknesses for the mold walls or the progress of the casting operation). Thus, for a temperature difference after 56 minutes, with a mold-material density of 1.75 grams per cubic centimeter (g/cm$^3$) and a diameter (d) of mold portion 4*b* of 250 millimeters (mm), the wall thickness (w) at the lower portion 2*a* is 36 millimeters.

The formation of different wall thicknesses can, among other things, be carried out by differing dipping of the various mold parts or by a contoured profiling if the backfilling is, in turn, obtained by different shaping and dimensioning of the mold box. The resulting profiled external contour of the mold defines differing wall thicknesses so as to obtain locally different cooling characteristics in the mold.

While the value of the heat-decrease necessary in the casting for the soundfeeding of the casting is positively provided by the geometry and material of the casting, the requirements for producing the necessary heat decrease may vary within a wide range, depending on the other operational requirements and possibilities, such as the initial temperature at the beginning of the cooling-down process, the duration of the cooling, the wall-thicknesses of the various parts of the mold, the densities of the various parts of the mold, the inherent cooling or insulating or heating means as they affect one another. Care must be taken, particularly at thin parts of the casting, that the inner walls of the mold remain hot enough to ensure proper flowing of the metal, and to prevent premature stoppage of the flow of metal.

Referring to FIG. 2, in addition to the variations of wall thickness, other means may be used to obtain locally different cooling characteristics in various locations of the mold. Thus, the mold, shown here as a shell 5 with a back-filling 6, may have massive inserts 7 made of metal or of cermet material embedded in the filling 6 with a hollow space (not shown) or an elastic intermediate insert provided between the filling 6 and the insert 7 through which the different heat-expansions of the filling 6 and inserts 7 become compensated. These inserts 7 allow the mean density in the mold portion 4*b* to be increased considerably relative to that in the mold portion 4*a*, thus greatly decreasing the cooling speed.

In addition, an insulating hood 8 is placed over the mold portion 4*b* and is supported on a support 9, which serves at the same time to support the mold and also to screen the upper mold portion 4*b* from a cooling flow, e.g. of cold air which comes from an annular channel 11 through openings 12 to cool the lower portion 4*a* of the mold.

The insulating hood 8 which may, if desired, be heated is set over the mold portion 4*b* at the beginning of the cooling-down phase and is removed before the casting operation.

The various means shown in FIG. 2, for obtaining the different local cooling characteristics in various locations of the mold may be used either singly or in combination. Also, it is possible, if desired, to considerably increase the temperature gradients in the mold inner wall in the solidification direction.

1. A precision casting process for producing a casting comprising the steps of preheating a ceramic casting mold having a differing wall thickness to a temperature above the maximum local casting temperature of the mold;

thereafter cooling a predetermined location in the mold to a predetermined temperature below said maximum casting temperature while allowing the remaining locations in the mold to cool at different rates;

maintaining the temperature of the mold in the desirable direction of solidification of the casting at a decrease of at least 10° C per centimeter of distance from a feed end of the cavity towards an opposite end;

subsequently pouring a molten metal into the mold; and varying the solidification time of the melt in the mold cavity in the desirable direction of solidification at a controlled rate, the solidification time being lower in the colder portions of the mold than in the warmer portions.

2. A precision casting process as set forth in claim 1 wherein said step of cooling is carried out in air for a specified time.

3. A precision casting process as set forth in claim 1 wherein the remaining locations of the mold are made of different densities from the predetermined location to effect said cooling at different rates.

4. A precision casting process comprising the steps of providing a heated casting mold having a profiled external contour defining differing wall thicknesses, a mold cavity within said walls and a prevailing temperature decreasing from the feeding end towards the opposite end of the cavity, at a rate of at least 10° C per centimeter of distance;

decreasing the temperature of the mold at a controlled rate from the feeding end of the mold to the opposite end of the mold to obtain locally different cooling characteristics in the mold; and thereafter pouring a molten melt into the mold cavity.

5. A precision casting process comprising the steps of providing a preheated casting mold having a profiled external contour defining differing wall thicknesses to obtain locally different cooling characteristics in the mold, a mold cavity within said walls, and a prevailing temperature decreasing from a feed end of the cavity towards an opposite end at a rate of at least 10° C per centimeter of distance;

subsequently pouring a molten metal melt into the feed end of the mold cavity; and increasing the solidification time of the melt in the mold cavity in the direction of solidification at a controlled rate to maintain the heat-content per unit volume in the unsolidified melt portions greater than in the adjacent solidified melt portions.

* * * * *